US006981896B2

(12) United States Patent
Su

(10) Patent No.: US 6,981,896 B2
(45) **Date of Patent: *Jan. 3, 2006**

(54) PLUG INNER FRAME WITH TWISTED BLADES

(75) Inventor: Tun Li Su, Kaohsiung Hsien (TW)

(73) Assignee: Gem Terminal Ind. Co., Ltd., kaohsiung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/060,145

(22) Filed: Feb. 1, 2002

(65) Prior Publication Data

US 2003/0148665 A1 Aug. 7, 2003

(51) Int. Cl.
*H01R 13/04* (2006.01)

(52) U.S. Cl. ..... 439/606; 439/693

(58) Field of Classification Search ..... 439/106, 439/695, 696, 693, 606, 736
See application file for complete search history.

(56) References Cited

U.S. PATENT DOCUMENTS

| | | | | | |
|---|---|---|---|---|---|
| 5,378,162 | A | * | 1/1995 | Waible | 439/606 |
| 5,603,638 | A | * | 2/1997 | Brown et al. | 439/606 |
| 5,647,751 | A | * | 7/1997 | Shulman et al. | 439/606 |
| 5,662,484 | A | * | 9/1997 | Blanche | 439/606 |
| 6,168,443 | B1 | * | 1/2001 | Mullen, Jr. et al. | 439/606 |
| 6,290,512 | B1 | * | 9/2001 | Mullen, Jr. | 439/606 |
| 6,482,036 | B1 | * | 11/2002 | Broussard | 439/606 |

* cited by examiner

*Primary Examiner*—Gary Paumen
(74) *Attorney, Agent, or Firm*—Rosenberg, Klein & Lee

(57) ABSTRACT

A plug inner frame comprises a frame in the form of a block and at least two blades securely held by the frame. Each blade includes an enclosed section and an exposed section. Each blade includes an end having a wire-receiving groove. A neck is defined between the wire-receiving groove and the exposed section. The neck of each blade is so twisted that the wire-receiving grooves of the blades face the same direction.

1 Claim, 14 Drawing Sheets

PLUG INNER FRAME WITH TWISTED BLADES

BACKGROUND OF THE INVENTION

1. Field of the Invention

The present invention relates to a plug inner frame with twisted blades to reduce the manufacture cost.

2. Description of the Related Art

A plug is a necessary element to all kinds of computers, electric appliances, etc and thus plays an important role in daily life. A typical plug generally comprises two or three blades or prongs manufacture, a wire is attached to an end of each blade, and the blades are then embedded into an inner frame. The semi-product comprised of the wires and the blades embedded in the inner frame is then placed into a mold for subsequent injection molding to form the final plug with a housing.

Most advanced countries require each blade of the plug to be partially wrapped by an insulating layer at an exposed section thereof, thereby avoiding electric shocks in case that the plug is loosened. The insulating layer is generally made of plastic material and wraps a portion of the exposed section of the blade by means of injection molding. However, the insulating layer is apt to be disengaged from the smooth metal surface of the blade as a result of poor bonding force therebetween. Thus, the insulating layer would slide easily, and sometimes may even fall. The blade is then exposed again and thus could cause an electric shock.

FIG. 1 of the drawings illustrates a conventional plug blade 1 including an enclosed section 11 and an exposed section 12. The exposed section 12 includes a wider front section 121 and a narrower rear section 122 having a transverse through-hole 123. Plastic material is filled to a face of the narrower rear section 122 and flows through the transverse through-hole 123 to the other face of the narrower rear section 122. An insulating layer is formed on the narrower rear section 122 after hardening of the plastic material. The bonding force between the insulating layer and the narrower rear section 122 is improved, and the time for filling the plastic material is reduced. FIG. 2 shows another conventional plug blade 1 that is substantially identical to that of the plug blade 1 in FIG. 1, except that the upper and lower faces of the narrower rear section 122 are respectively flush with those of the wider front section 121.

However, an end of a wire must be inserted into and thus embraced by an end of each blade of the plug before subsequent procedure. The blades must face the same direction when proceeding with this wire-inserting procedure in an associated wire-inserting machine. In some countries, the blades of a plug are twisted such that the wire-inserting grooves of the blades face different directions. The current wire-inserting machine could not proceed with the wire-inserting procedure on the plugs with twisted blades. The manufacture cost is largely increased when seeking a solution to this end. In addition, a fault (generally a shallow recess) is formed on a surface of the insulating layer after hardening of the plastic material. The appearance of the plug is thus adversely affected.

SUMMARY OF THE INVENTION

An object of the present invention is to provide a plug inner frame with twisted blades to reduce the manufacture cost.

Another object of the present invention is to provide a plug inner frame with twisted blades having an aesthetic appearance.

A plug inner frame in accordance with the present invention comprises a frame in the form of a block and at least two blades securely held by the frame. Each blade includes an enclosed section and an exposed section. Each blade includes an end having a wire-receiving groove. A neck is defined between the wire-receiving groove and the exposed section. The neck of each blade is so twisted that the wire-receiving grooves of the blades face the same direction.

Other objects, advantages, and novel features of the invention will become more apparent from the following detailed description when taken in conjunction with the accompanying drawings.

DETAILED DESCRIPTION OF THE PREFERRED EMBODIMENTS

Figure 6:
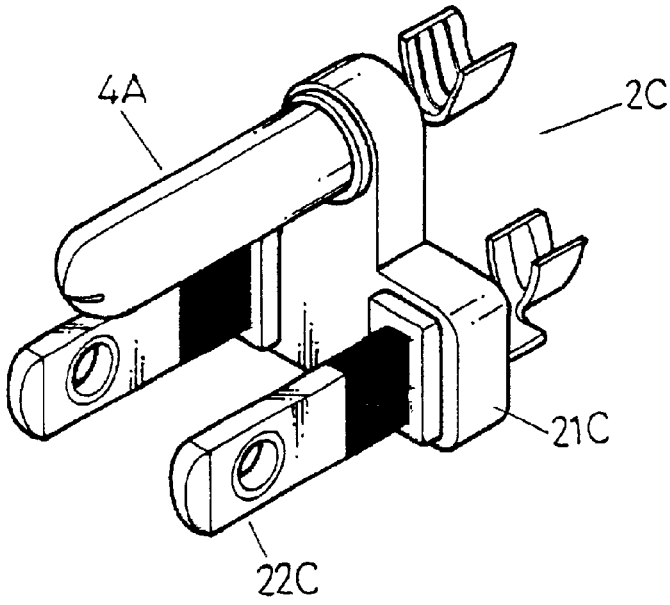
FIG. 6 is a perspective view of a fourth embodiment of the plug inner frame in accordance with the present invention.
Figure 7:
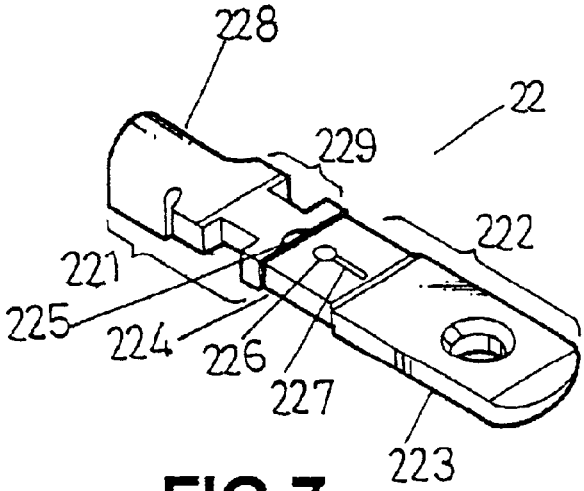
FIG. 7 is a perspective view illustrating a raw material for the plug blade.

FIG. 7 illustrates a raw material of a plug blade 22 for manufacturing a plug inner frame (FIGS. 3 and 6) of a final plug in accordance with the present invention. The plug blade 22 includes an enclosed section 221 to be enclosed by a housing (not labeled, see FIGS. 3 and 6) and an exposed section 222. The exposed section 222 includes a wider front section 223 and a narrower rear section 224. A transverse through-hole 226 extends from a face of the narrower rear section 224 to the other face of the narrower rear section 224. A reinforcing guide slot 227 is defined in the narrower rear section 224 and communicated with the transverse through-hole 226. Also, the reinforcing guide slot 227 extends from a face of the narrower rear section 224 to the other face of the narrower rear section 224. The enclosed section 221 includes a shallow recess 225 in a front end thereof for filling plastic material into the narrower rear section 224. The faces of the narrower rear section 224 are lower than those of the wider front section 223, and two lateral sides of the narrower rear section 224 are lower than those of the wider front section 223.

A wire-receiving groove 228 is defined in a rear end of the enclosed section 221. A neck 229 is formed between the wire-receiving groove 228 and the exposed section 222.

Figure 8:
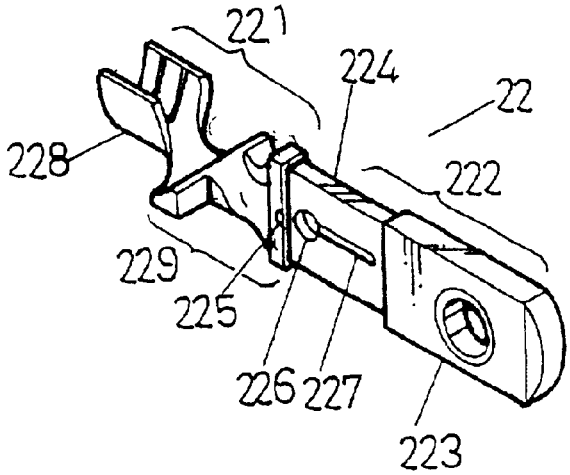
FIG. 8 is a perspective view illustrating a semi-product of the plug blade in FIG. 7.
Figure 9:
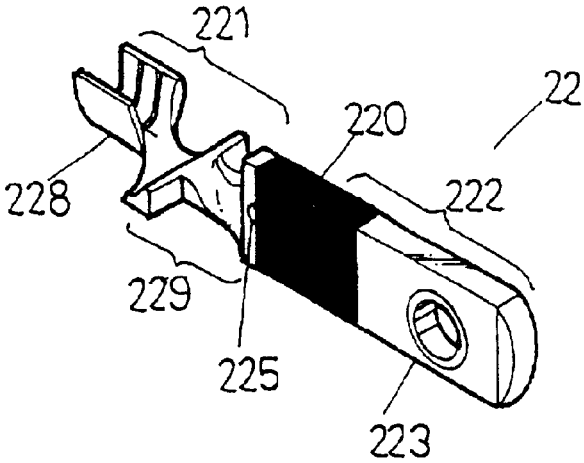
FIG. 9 is a perspective view illustrating the semi-product of FIG. 8 having an insulating layer formed thereon.

The neck 229 of the plug blade 22 in FIG. 7 is twisted to form a plug blade 22 shown in FIG. 8 such that the wire-receiving groove 228 faces upward for allowing easy insertion of an end of a wire. Next, an insulating layer 220 is formed on the narrower rear section 224, as shown in FIG. 9. It is achieved by means of filling molten plastic material into the narrower rear section 224 via the shallow recess 225. The molten plastic material flows from a face to the other face of the narrower rear section 224 via the transverse through-hole 226 and the slot 227. The insulating layer 220 is formed after hardening of the plastic material.

Figure 1:
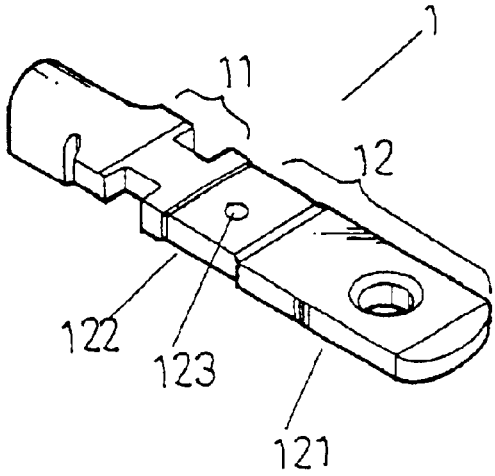
FIG.1 (PRIOR ART)
FIG. 1 is a perspective view of a conventional plug blade.
Figure 2:
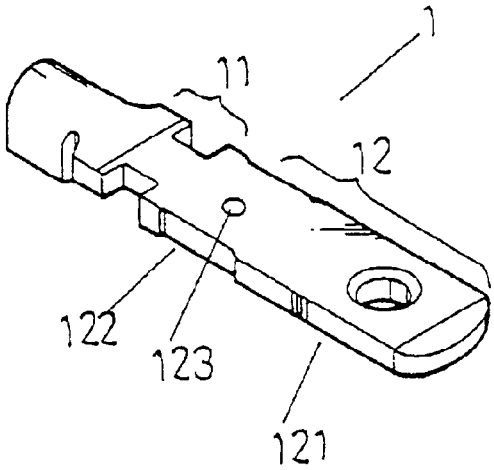
FIG.2 (PRIOR ART)
FIG. 2 is a perspective view of another conventional plug blade.
Figure 3:
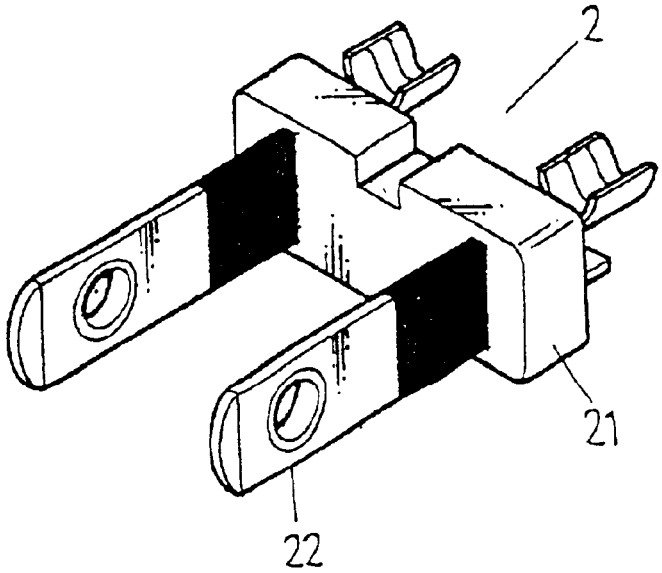
FIG. 3 is a perspective view of a first embodiment of a plug inner frame in accordance with the present invention.
Figure 10:
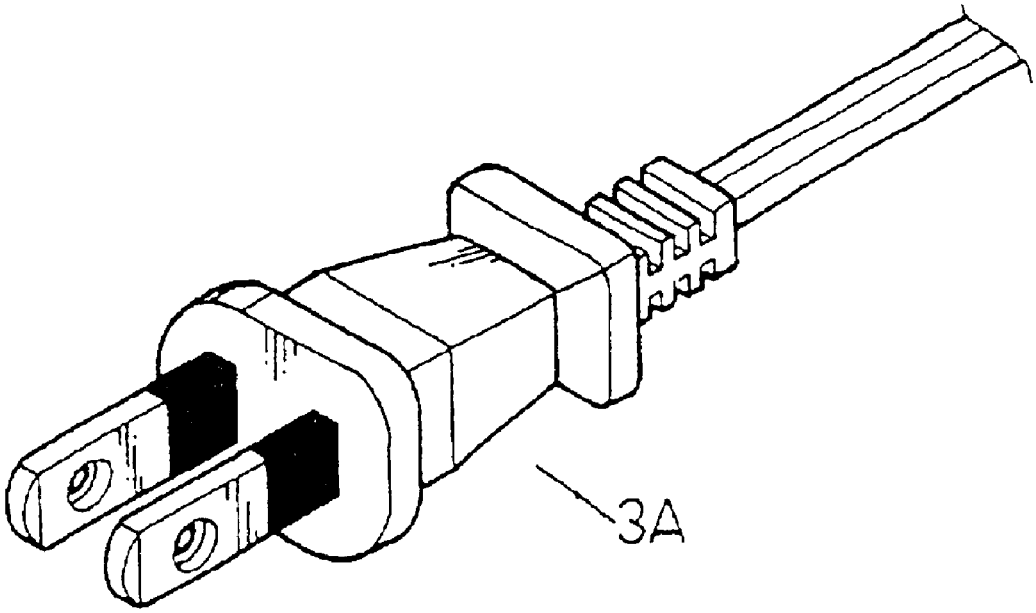
FIG. 10 is a perspective view of a final plug made from the plug inner frame in FIG. 3.
Figure 11:
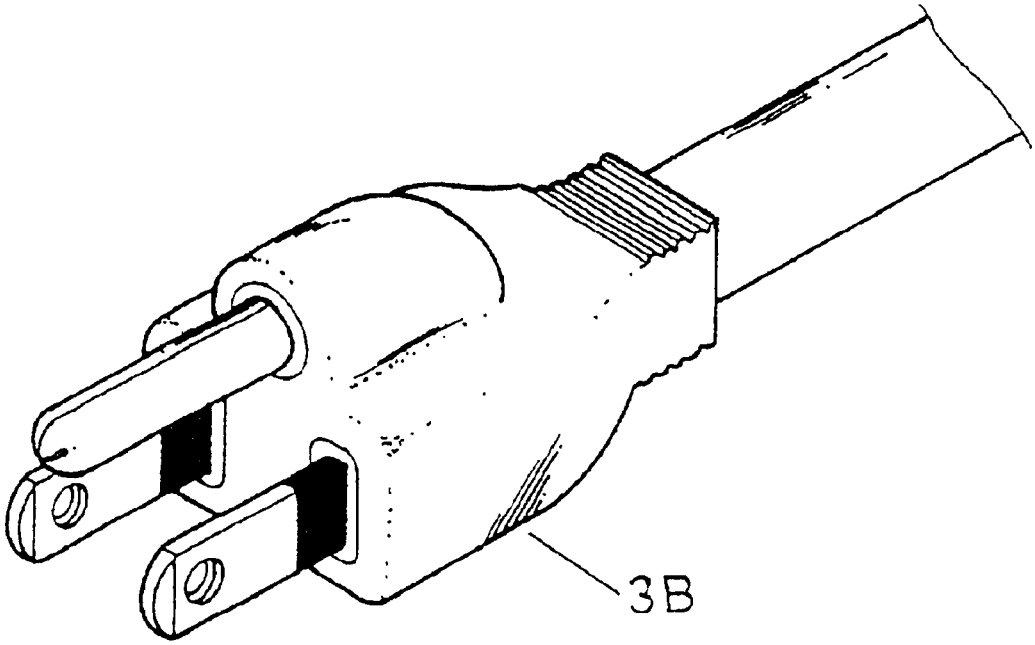
FIG. 11 is a perspective view of a final plug made from the plug inner frame in FIG. 6.

Next, two of the plug blades 22 in FIG. 8 can be placed into a mold, and plastic material is injected into the mold to form an inner frame 2 comprising a frame 21 in the form of a plug and two plug blades 22 securely held by the frame 21, best shown in FIG. 3. FIG. 10 is a perspective view of a final plug 3A made from the plug inner frame 2 in FIG. 3 after an injection molding procedure. Alternatively, the plug blade 22 in FIG. 9 can be used to form an inner frame 2C shown in FIG. 6. The inner frame 2C includes a frame 21C, two blades 22C, and a grounding prong 4A. FIG. 11 is a perspective view of a final plug 3B made from the plug inner frame 2C in FIG. 6 after an injection molding procedure.

Figure 4:
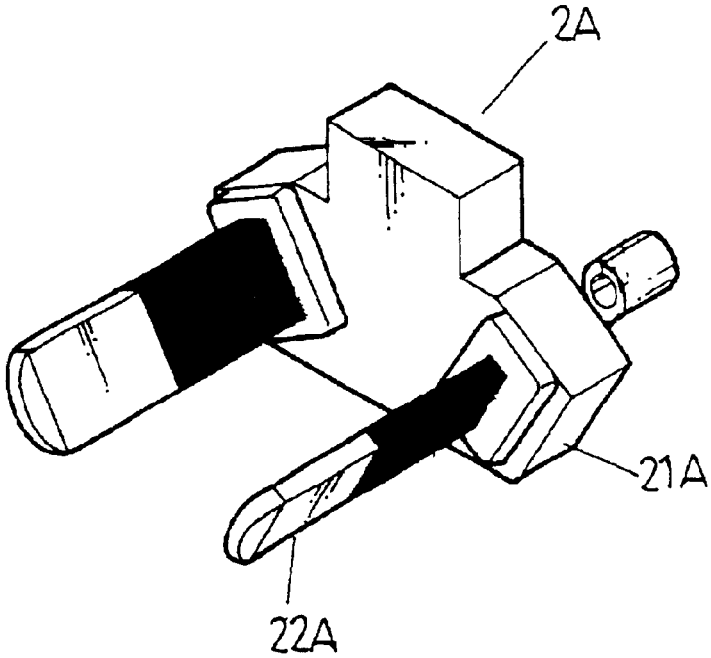
FIG. 4 is a perspective view of a second embodiment of the plug inner frame in accordance with the present invention.
Figure 5:
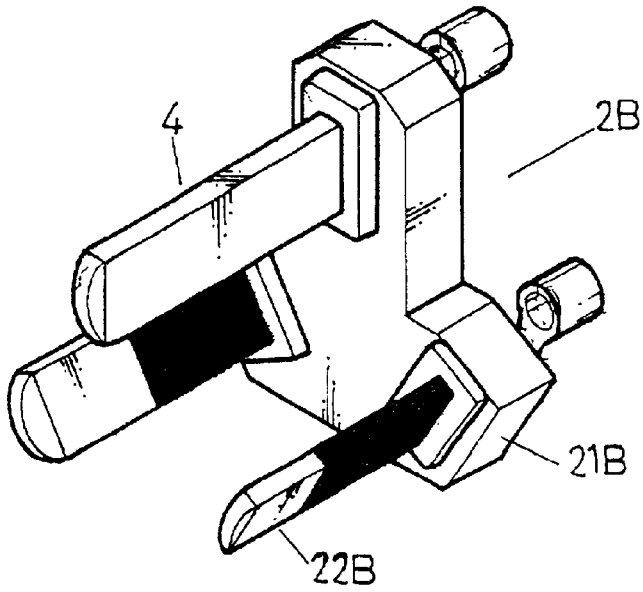
FIG. 5 is a perspective view of a third embodiment of the plug inner frame in accordance with the present invention.
Figure 12:
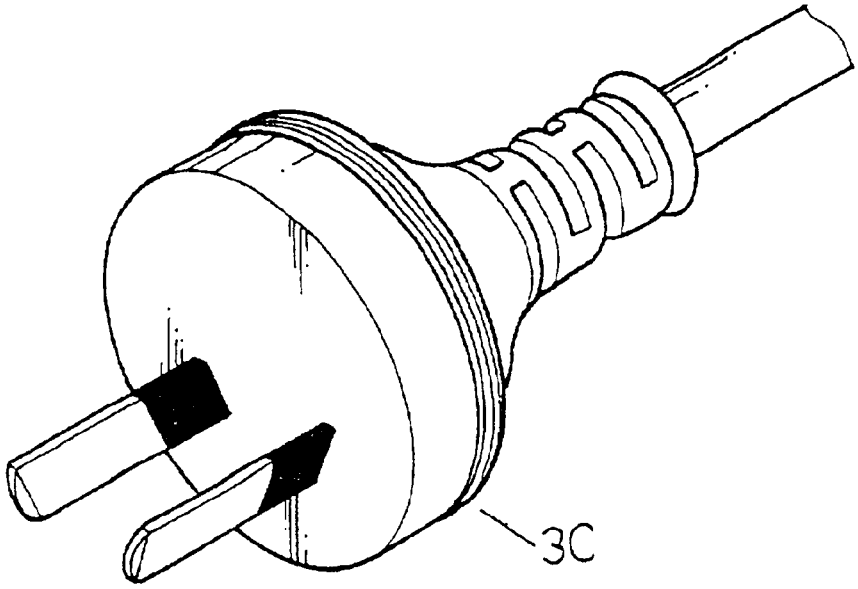
FIG. 12 is a perspective view of a final plug made from the plug inner frame in FIG. 4.
Figure 13:
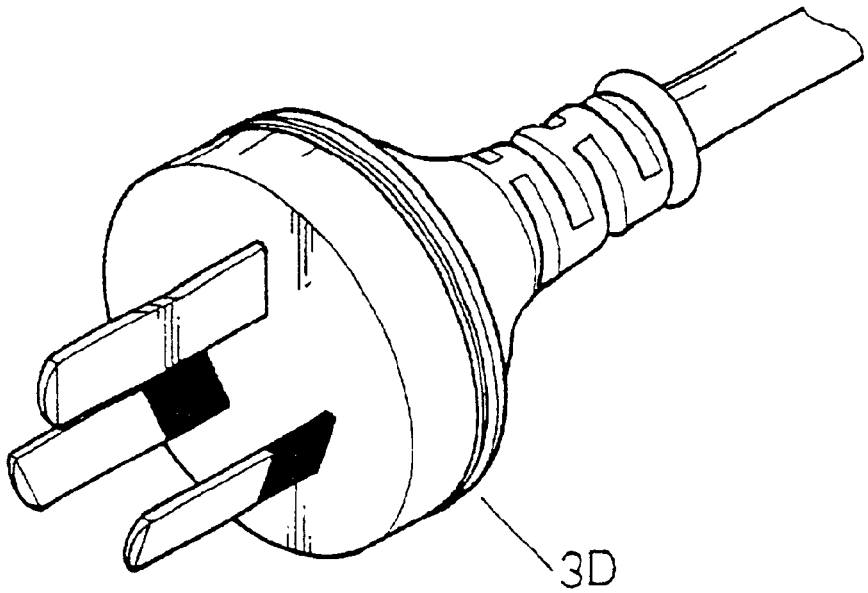
FIG. 13 is a perspective view of a final plug made from the plug inner frame in FIG. 5.
Figure 25:
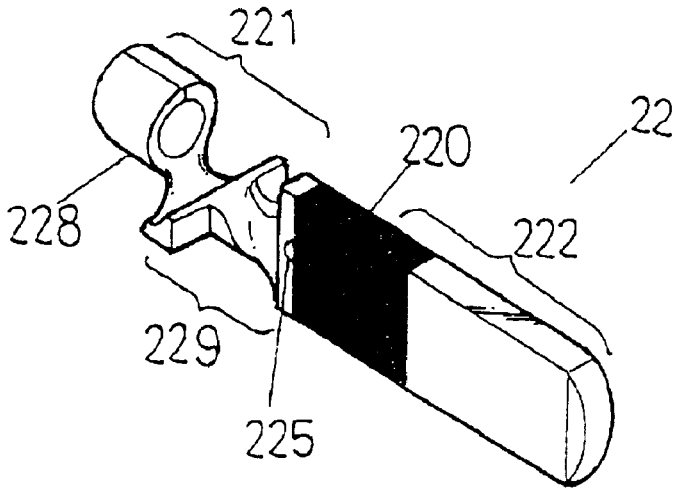
FIG. 25 is a perspective view of an embodiment modified from the semi-product of the plug blade of FIG. 9.

FIG. 25 illustrate an embodiment modified from the embodiment of FIG. 9, wherein the hole in the exposed section 222 in FIG. 9 is omitted, and the wire-receiving groove 228 is in the form of a circle. The plug blade 22 in FIG. 25 can be used to form an inner frame 2A shown in FIG. 4. The inner frame 2A includes a frame 21A and two blades 22A. FIG. 12 is a perspective view of a final plug 3C made from the plug inner frame 2A in FIG. 4 after an injection molding procedure. Alternatively, the plug blade 22 in FIG. 25 can be used to form an inner frame 2B shown in FIG. 5. The inner frame 2B includes a frame 21B, two blades 22B, and a grounding prong 4. FIG. 13 is a perspective view of a final plug 3D made from the plug inner frame 2B in FIG. 5 after an injection molding procedure.

Figure 17:
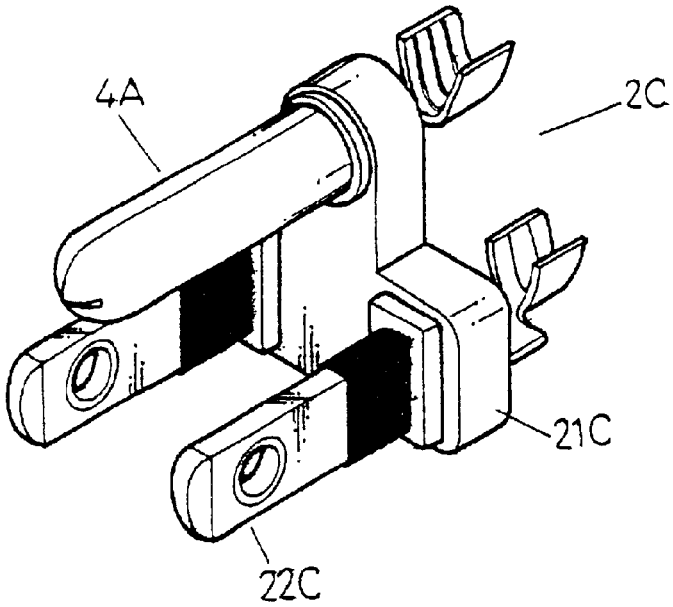
FIG. 17 is a perspective view of an eight embodiment of the plug inner frame in accordance with the present invention.
Figure 18:
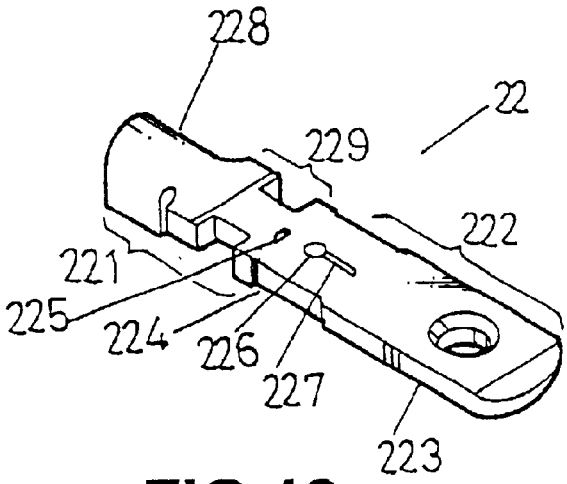
FIG. 18 is a perspective view illustrating another raw material for the plug blade.

FIG. 18 illustrates another embodiment of a raw material of a plug blade 22 for manufacturing a plug inner frame (FIGS. 14 and 17) in accordance with the present invention. The plug blade 22 includes an enclosed section 221 to be enclosed by a housing (not labeled, see FIGS. 14 and 17) of a final plug and an exposed section 222. The exposed section 222 includes a wider front section 223 and a narrower rear section 224. A transverse through-hole 226 extends from a face of the narrower rear section 224 to the other face of the narrower rear section 224. A reinforcing guide slot 227 is defined in the narrower rear section 224 and communicated with the transverse through-hole 226. Also, the reinforcing guide slot 227 extends from a face of the narrower rear section 224 to the other face of the narrower rear section. The enclosed section 221 includes a shallow recess 225 in a front end thereof for filling plastic material into the narrower rear section 224. The faces of the narrower rear section 224 are flush with those of the wider front section 223, and two lateral sides of the narrower rear section 224 are lower than those of the wider front section 223.

A wire-receiving groove 228 is defined in a rear end of the enclosed section 221. A neck 229 is formed between the wire-receiving groove 228 and the exposed section 222.

Figure 19:
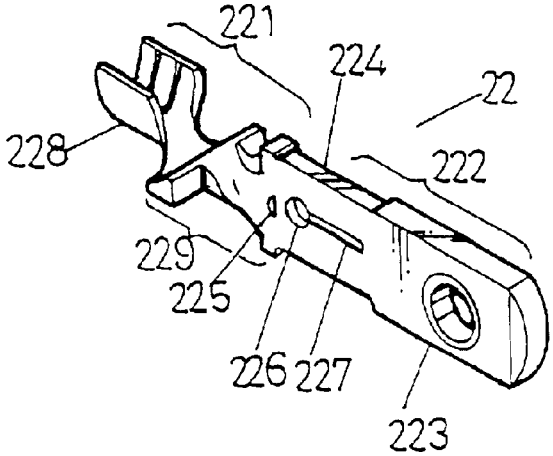
FIG. 19 is a perspective view illustrating a semi-product of the plug blade in FIG. 18.
Figure 20:
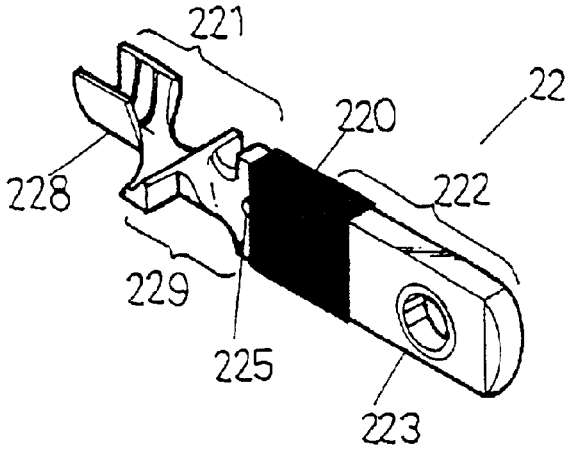
FIG. 20 is a perspective view illustrating the semi-product of FIG. 19 having an insulating layer formed thereon.

The neck 229 of the plug blade 22 in FIG. 18 is twisted to form a plug blade 22 shown in FIG. 19 such that the wire-receiving groove 228 faces upward for allowing easy insertion of an end of a wire. Next, an insulating layer 220 is formed on the narrower rear section 224, as shown in FIG. 20. It is achieved by means of filling molten plastic material into the narrower rear section 224 via the shallow recess 225. The molten plastic material flows from a face to the other face of the narrower rear section 224 via the transverse through-hole 226 and the slot 227. The insulating layer 220 is formed after hardening of the plastic material.

Figure 14:
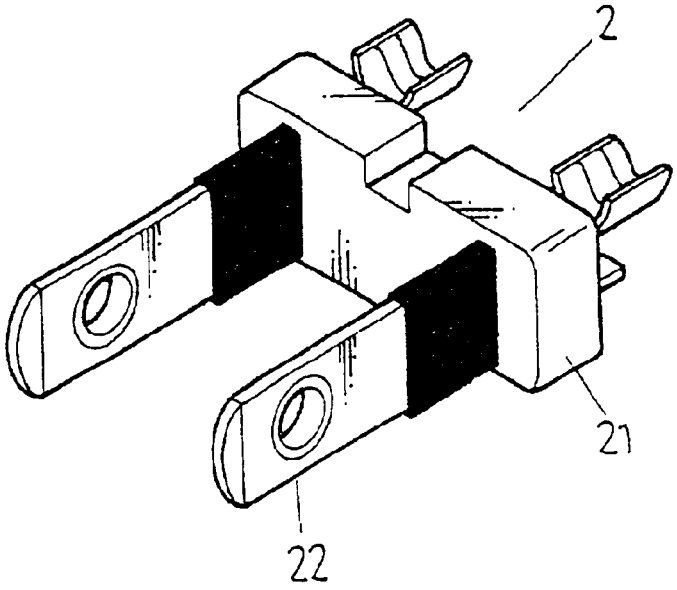
FIG. 14 is a perspective view of a fifth embodiment of the plug inner frame in accordance with the present invention.
Figure 21:
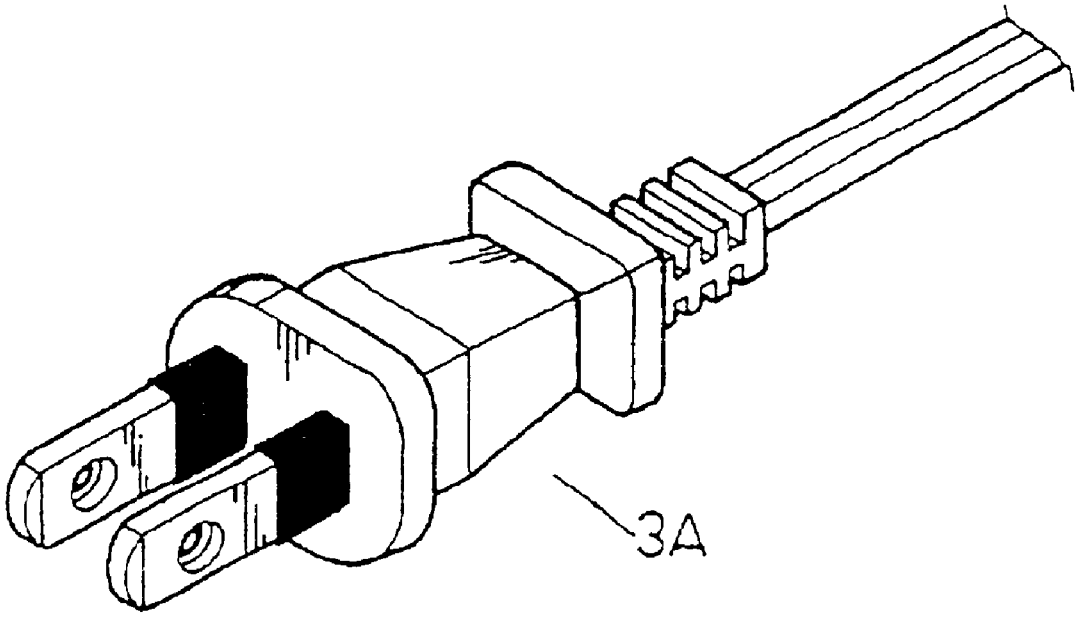
FIG. 21 is a perspective view of a final plug made from the plug inner frame in FIG. 14.
Figure 22:
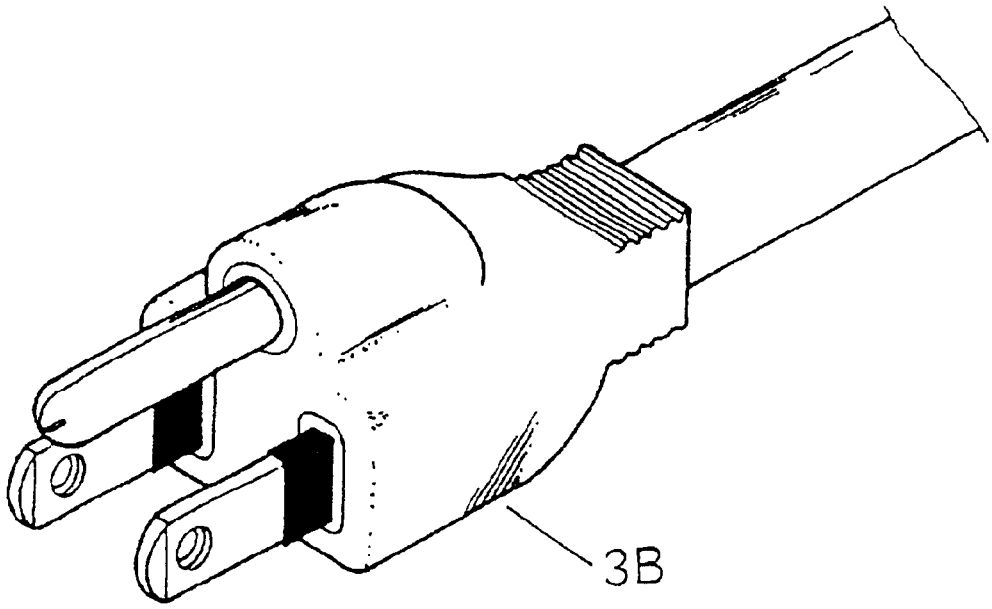
FIG. 22 is a perspective view of a final plug made from the plug inner frame in FIG. 17.

Next, two of the plug blades 22 in FIG. 20 can be placed into a mold, and plastic material is injected into the mold to form an inner frame 2 comprising a frame 21 in the form of a block and two plug blades 22, best shown in FIG. 14. FIG. 21 is a perspective view of a final plug 3A made from the plug inner frame 2 in FIG. 14 after an injection molding procedure. Alternatively, the plug blade 22 in FIG. 20 can be used to form an inner frame 2C shown in FIG. 17. The inner frame 2C includes a frame 21C, two blades 22C, and a grounding prong 4A. FIG. 22 is a perspective view of a final plug 3B made from the plug inner frame 2C in FIG. 17 after an injection molding procedure.

Figure 15:
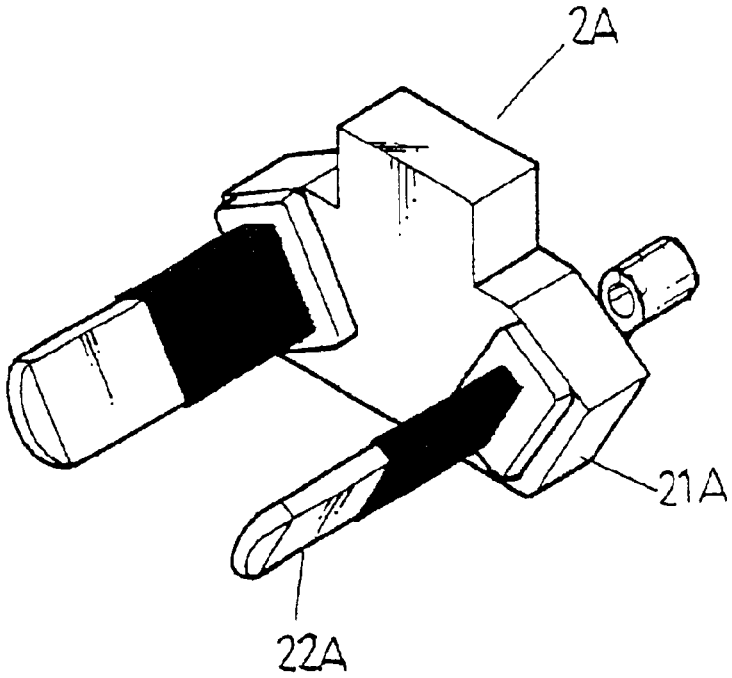
FIG. 15 is a perspective view of a sixth embodiment of the plug inner frame in accordance with the present invention.
Figure 16:
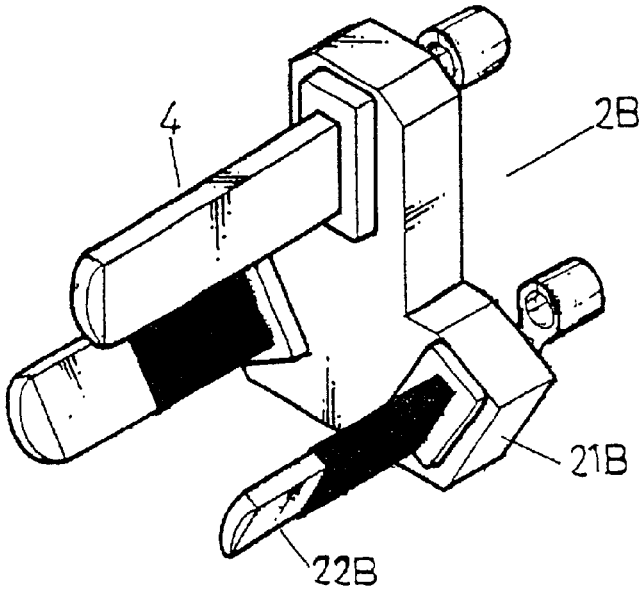
FIG. 16 is a perspective view of a seventh embodiment of the plug inner frame in accordance with the present invention.
Figure 23:
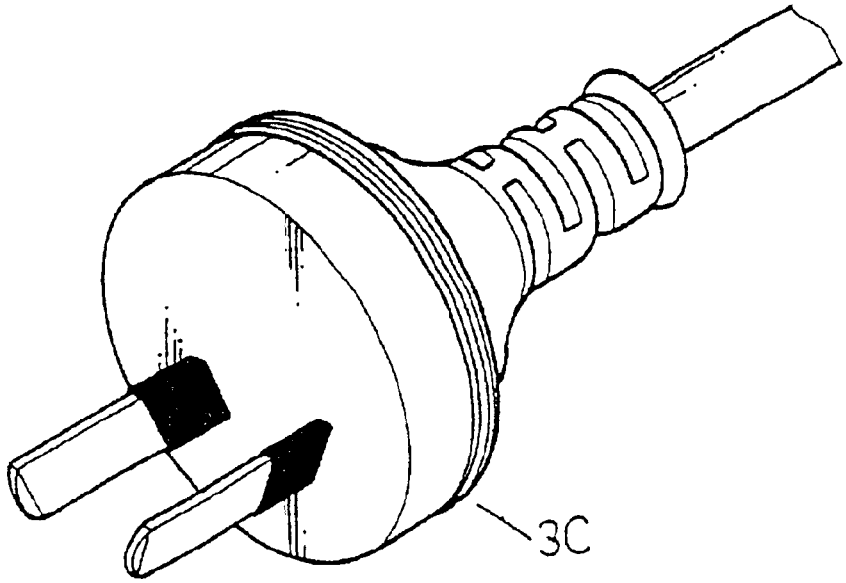
FIG. 23 is a perspective view of a final plug made from the plug inner frame in FIG. 15.
Figure 24:
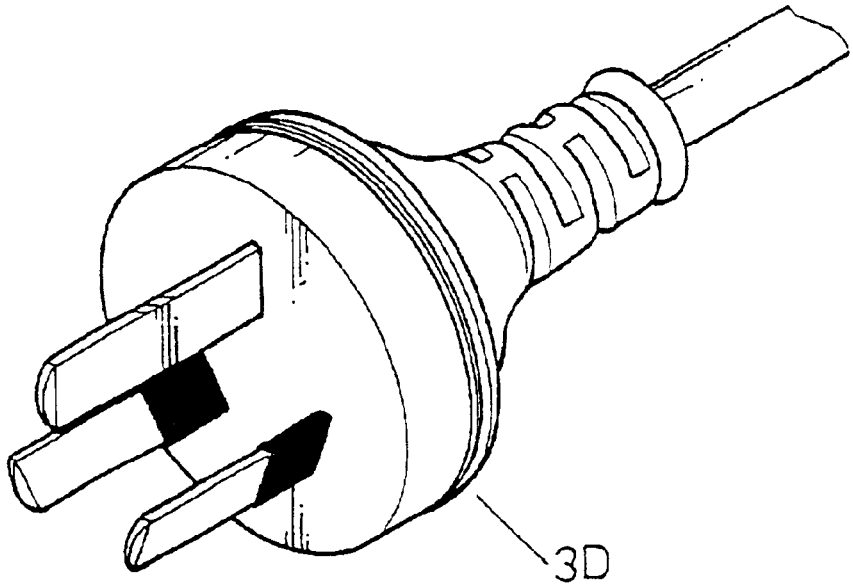
FIG. 24 is a perspective view of a final plug made from the plug inner frame in FIG. 16.
Figure 26:
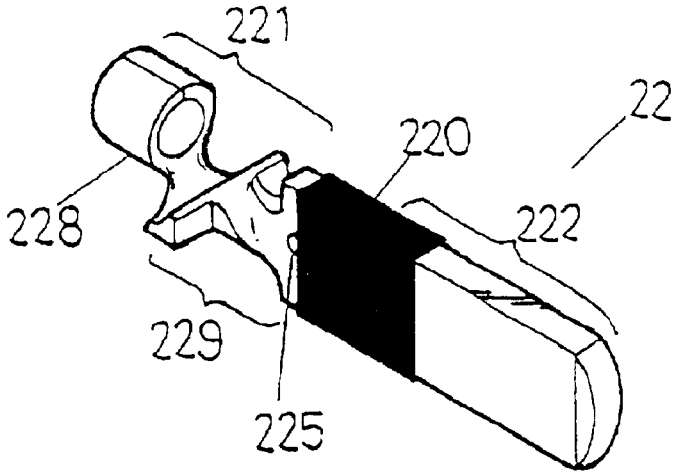
FIG. 26 is a perspective view of an embodiment modified from the semi-product of the plug blade of FIG. 20.

FIG. 26 illustrate an embodiment modified from the embodiment of FIG. 20, wherein the hole in the exposed section 222 in FIG. 20 is omitted, and the wire-receiving groove 228 is in the form of a circle. The plug blade 22 in FIG. 26 can be used to form an inner frame 2A shown in FIG. 15. The inner frame 2A includes a frame 21A and two blades 22A. FIG. 23 is a perspective view of a final plug 3C made from the plug inner frame 2A in FIG. 15 after an injection molding procedure. Alternatively, the plug blade 22 in FIG. 26 can be used to form an inner frame 2B shown in FIG. 16. The inner frame 2B includes a frame 21B, two blades 22B, and a grounding prong 4. FIG. 24 is a perspective view of a final plug 3D made from the plug inner frame 2B in FIG. 16 after an injection molding procedure.

According to the above description, it is noted that the procedure for a current wire-inserting machine needs no change, as the inner frame 2, 2A, 2B, 2C in accordance with the present invention with twisted blades 22, 22A, 22B, 22C allows the wire-receiving holes 228 to face the same direction. The fault resulting from the formation of the insulating layer is located in a position adjacent to the shallow recess 225 for filling the molten plastic material. Nevertheless, the shallow recess 225 is enclosed by the housing after formation of the whole plug 3A, 3B, 3C, 3D. Thus, the appearance of the insulating layer is not adversely affected. Further, due to provision of the reinforcing guide slot 227 communicated with the transverse through-hole 226, the air on the faces of the metal blade can be well expelled, and the molten plastic material flowing randomly on the faces of the metal blades may flow from one face to the other of each metal blade. Thus, the thickness of the insulating layer is more uniform after formation. Further, the overall structure of the plug blade has appropriate rigidity from metal and appropriate softness from the plastic material, thereby having an optimal resistance to bending. The finally formed plugs 3A, 3B, 3C, and 3D meet requirements of different countries.

Although the invention has been explained in relation to its preferred embodiment, it is to be understood that many other possible modifications and variations can be made without departing from the scope of the invention as hereinafter claimed.

What is claimed is:

1. A plug inner frame comprising:

a frame in the form of a block; and at least two blades securely held by the frame, each said blade including an enclosed section and an exposed section, each said blade including an end having a wire-receiving groove, a neck being defined between said wire-receiving groove and said exposed section, each said neck being so twisted that said wire-receiving grooves of said blades face the same direction;

said exposed section of each said blade including a wider front section and a narrower rear section, said narrower rear section including a first face and a second face opposite to said first face, a transverse through-hole being defined in said narrower rear section and extending from said first face through said second face, further comprising a reinforcing guide slot defined in said narrower section and communicating with said transverse through-hole, said reinforcing guide slot extending from said first face through said second face of said narrower rear section.

* * * * *